US006349413B1

(12) United States Patent
Rose et al.

(10) Patent No.: US 6,349,413 B1
(45) Date of Patent: Feb. 26, 2002

(54) GARMENT WITH REMOVABLE APPENDAGE PORTION

(76) Inventors: Selborn Rose; Romania Sutherland-Rose, both of 259 Parkside Ave. #3-A, Brooklyn, NY (US) 11226

( * ) Notice: Subject to any disclaimer, the term of this patent is extended or adjusted under 35 U.S.C. 154(b) by 0 days.

(21) Appl. No.: 09/802,542

(22) Filed: Mar. 9, 2001

(51) Int. Cl.[7] ..... A41B 1/00
(52) U.S. Cl. ..... 2/126; 2/269
(58) Field of Search ..... 2/115, 125, 269, 2/126, 227, 228, 238, 912, 913, 919, 920, 914

(56) References Cited

U.S. PATENT DOCUMENTS 2,104,826 A * 1/1938 Stramiello ..... 2/126
3,002,193 A 10/1961 Briskman
3,961,376 A 6/1976 Howell
D249,097 S 8/1978 Rahaim
4,766,613 A * 8/1988 Wells ..... 2/227
4,896,379 A * 1/1990 Kape ..... 2/269
5,067,179 A * 11/1991 Wormser ..... 2/269
5,088,128 A * 2/1992 Kape ..... 2/269
5,539,932 A 7/1996 Howard
5,774,892 A 7/1998 Tisdale et al.
6,185,745 B1 * 2/2001 Alger ..... 2/227

* cited by examiner

*Primary Examiner*—Gloria M. Hale

(57) ABSTRACT

A garment for providing a user with multiple looks and comfort levels from a single pair of pants and a shirt. The garment includes a main portion designed for covering a portion of the body of the user. A pair of appendage portions each is designed for receiving an appendage of the user. Each of the appendage portions is coupled to the main portion. Each of the appendage portions has an upper portion and a lower portion such that the lower portion is removably coupled to the upper portion.

7 Claims, 3 Drawing Sheets

GARMENT WITH REMOVABLE APPENDAGE PORTION

BACKGROUND OF THE INVENTION

1. Field of the Invention

The present invention relates to garments and more particularly pertains to a new garment for providing a user with multiple looks and comfort levels from a single pair of pants and a shirt.

2. Description of the Prior Art

The use of garments is known in the prior art. More specifically, garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,774,892; 3,961,376; 4,766,613; 4,766,613; 5,539,932; 3,002,193; and U.S. Pat. No. Des. 249,097.

While these devices fulfill their respective, particular objectives and requirements, the aforementioned patents do not disclose a new garment. The inventive device includes a main portion designed for covering a portion of the body of the user. A pair of appendage portions each is designed for receiving an appendage of the user. Each of the appendage portions is coupled to the main portion. Each of the appendage portions has an upper portion and a lower portion such that the lower portion is removably coupled to the upper portion.

In these respects, the garment according to the present invention substantially departs from the conventional concepts and designs of the prior art, and in so doing provides an apparatus primarily developed for the purpose of providing a user with multiple looks and comfort levels from a single pair of pants and a shirt.

SUMMARY OF THE INVENTION

In view of the foregoing disadvantages inherent in the known types of garments now present in the prior art, the present invention provides a new garment construction wherein the same can be utilized for providing a user with multiple looks and comfort levels from a single pair of pants and a shirt.

The general purpose of the present invention, which will be described subsequently in greater detail, is to provide a new garment apparatus and method which has many of the advantages of the garments mentioned heretofore and many novel features that result in a new garment which is not anticipated, rendered obvious, suggested, or even implied by any of the prior art garments, either alone or in any combination thereof.

To attain this, the present invention generally comprises a main portion designed for covering a portion of the body of the user. A pair of appendage portions each is designed for receiving an appendage of the user. Each of the appendage portions is coupled to the main portion. Each of the appendage portions has an upper portion and a lower portion such that the lower portion is removably coupled to the upper portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garment apparatus and method which has many of the advantages of the garments mentioned heretofore and many novel features that result in a new garment which is not anticipated, rendered obvious, suggested, or even implied by any of the prior art garments, either alone or in any combination thereof.

It is another object of the present invention to provide a new garment, which may be easily and efficiently manufactured and marketed.

It is a further object of the present invention to provide a new garment, which is of a durable and reliable construction.

An even further object of the present invention is to provide a new garment which is susceptible of a low cost of manufacture with regard to both materials and labor, and which accordingly is then susceptible of low prices of sale to the consuming public, thereby making such garment economically available to the buying public.

Still yet another object of the present invention is to provide a new garment which provides in the apparatuses and methods of the prior art some of the advantages thereof, while simultaneously overcoming some of the disadvantages normally associated therewith.

Still another object of the present invention is to provide a new garment for providing a user with multiple looks and comfort levels from a single pair of pants and a shirt.

Yet another object of the present invention is to provide a new garment which includes a main portion designed for covering a portion of the body of the user. A pair of appendage portions each is designed for receiving an appendage of the user. Each of the appendage portions is coupled to the main portion. Each of the appendage portions has an upper portion and a lower portion such that the lower portion is removably coupled to the upper portion.

Still yet another object of the present invention is to provide a new garment that is ideal for kids; makes it easier to repair holes in pants or shirts simply by adding a new pant leg or sleeve. This would also allow the child to wear the same outfits longer as he/she grows.

Even still another object of the present invention is to provide a new garment that makes it easy to custom-design and personalize one's own wardrobe as well as easily and quickly adapt his or her apparel to changing climate conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
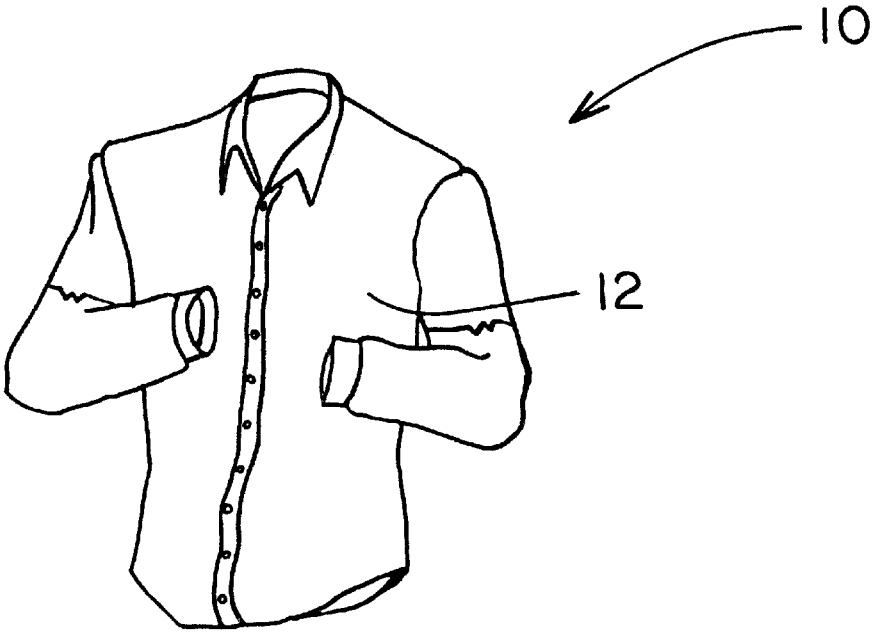
FIG. 1 is a perspective view of a new garment according to the present invention.
Figure 2:
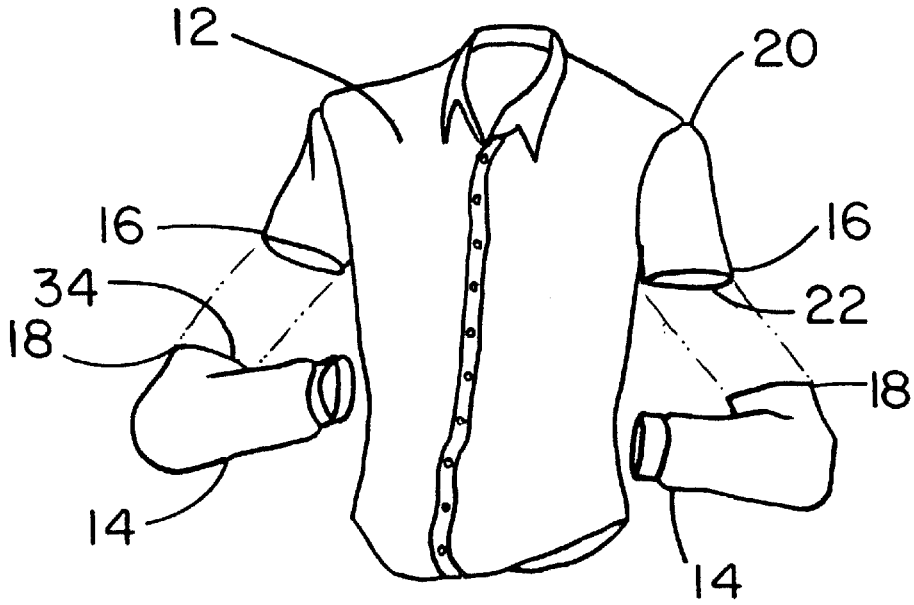
FIG. 2 is an expanded view of the present invention.
Figure 3:
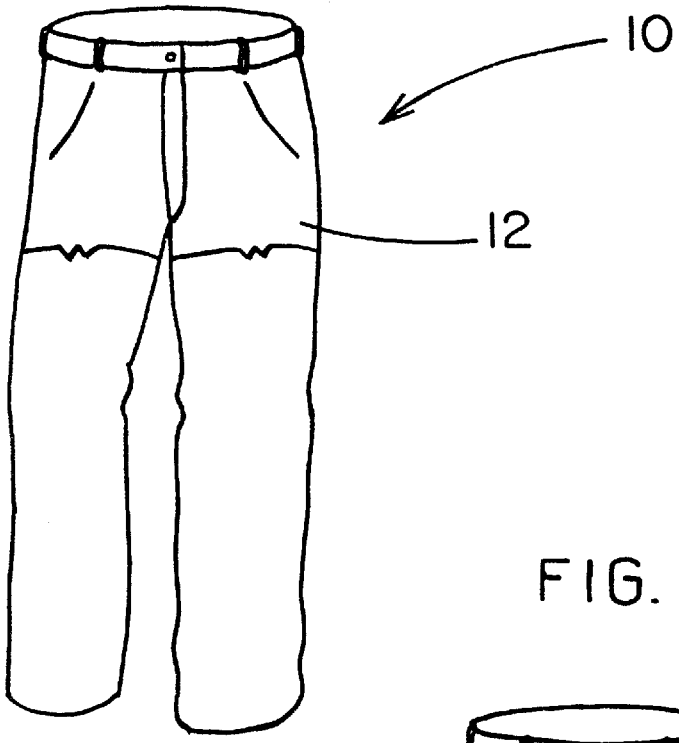
FIG. 3 is a perspective view of the present invention.
Figure 4:
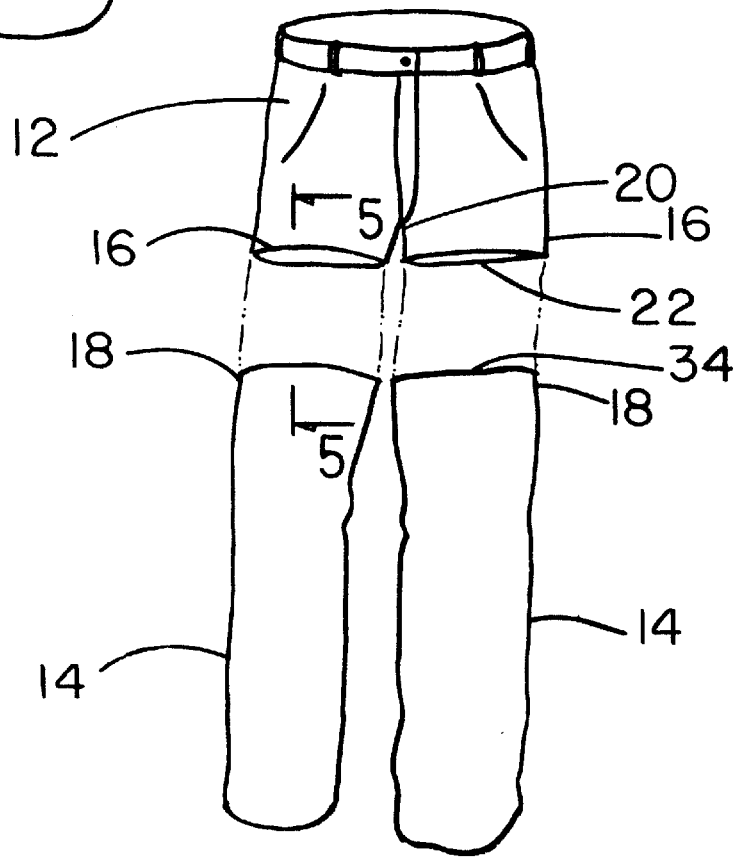
FIG. 4 is an expanded view of the present invention.
Figure 5:
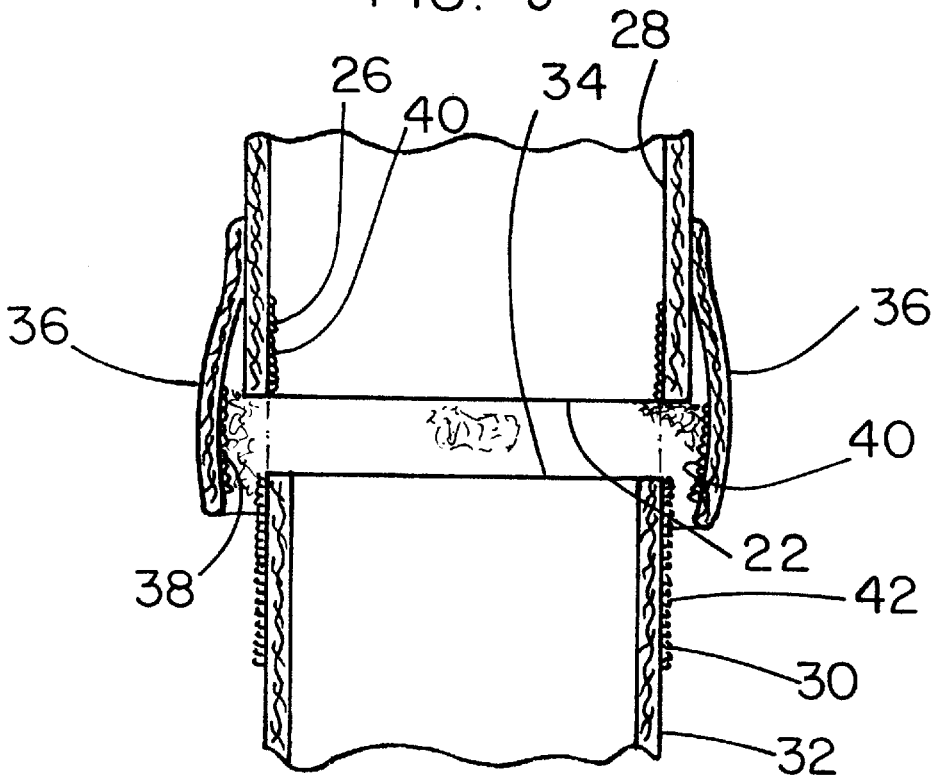
FIG. 5 is a cut-away view of the present invention.
Figure 6:
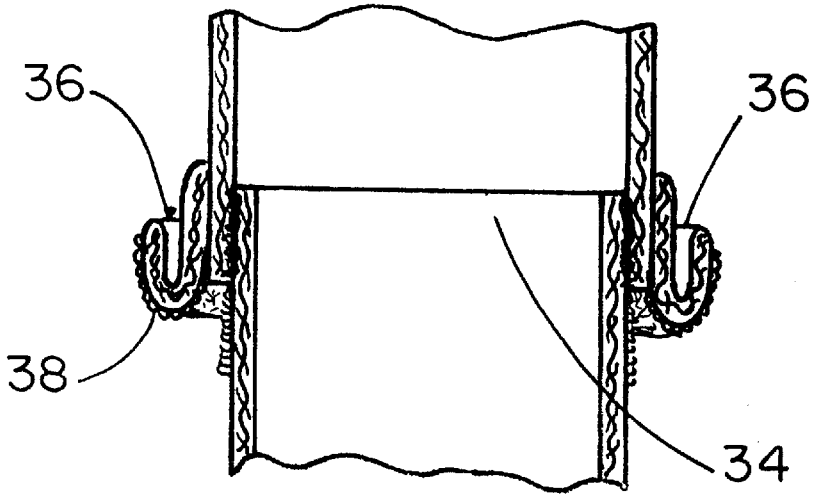
FIG. 6 is a cut-away view of the present invention.

With reference now to the drawings, and in particular to FIGS. 1 through 6 thereof, a new garment embodying the principles and concepts of the present invention and generally designated by the reference numeral 10 will be described.

As best illustrated in FIGS. 1 through 6, the garment 10 generally comprises a main portion 12 designed for covering a portion of the body of the user. A pair of appendage portions 14 each is designed for receiving an appendage of the user. Each of the appendage portions 14 is coupled to the main portion 12. Each of the appendage portions 14 has an upper portion 16 and a lower portion 18 such that the lower portion 18 is removably coupled to the upper portion 16.

The upper portion 16 of each of the appendage portions 14 has a first end 20 coupled to the main portion 12. The upper portion 16 has a free end 22 opposite the first end 20. The upper portion 16 of each of the appendage portions 14 has a first fastener 26 coupled to an interior surface 28 adjacent the free end 22.

The lower portion 18 of each of the appendage portions 14 has a second fastener 30 coupled to an exterior surface 32 of the lower portion 18 adjacent a distal end 34 of the lower portion 18. The second fastener 30 releasably engages the first fastener 26 of the upper portion 16.

Each of the appendage portions 14 comprise a flap 36 that is coupled to the upper portion 16 of each of the appendage portions 14 adjacent the free end 22. The flap 36 extends over the lower portion 18 such that the flap 36 is for preventing water from entering the lower portion 18 when the lower portion 18 is coupled to the upper portion 16. The flap 36 of each of the appendage portions 14 has a third fastener 38 that engages the second fastener 30 of the lower portion 18 such that the third fastener 38 is for securing the flap 36 to the lower portion 18 when the lower portion 18 is coupled to the upper portion 16.

The first fastener 26 and the third fastener 38 each comprise a first portion of hook and loop fastener 40, the second fastener 30 comprises a second portion of hook and loop fastener 42 such that the second portion of hook and loop fastener 42 is for releasably engages the first portion hook and loop fastener 40.

In use, a user would wear the present invention like a regular shirt and pants. The use(would have the flexibility to wear the pants as pant or shorts simply by removing the lower portion of the pant leg fastened by a hook and loop fastener; similarly the user could wear the shirt as a long sleeve shirt or a short sleeve shirt by removing the lower sleeve portion fastened by a hook and loop fastener.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A garment for wearing on a body of a user, the garment comprising:

a main portion adapted for covering a portion of the body of the user;

a pair of appendage portions each being adapted for receiving an appendage of the user, each of said appendage portions being coupled to said main portion, each of said appendage portions having an upper portion and a lower portion such that said lower portion is removably coupled to said upper portion;

said upper portion of each of said appendage portions having a first end coupled to said main portion, said upper portion having a free end opposite said first end, said upper portion of each of said appendage portions having a first fastener coupled to an interior surface adjacent said free end;

said lower portion of each of said appendage portions having a second fastener coupled to an exterior surface of said lower portion adjacent a distal end of said lower portion, said second fastener being for releasably engaging said first fastener of said upper portion;

each of said appendage portions comprising a flap coupled to said upper portion of each of said appendage portions adjacent said free end, said flap being for extending over said lower portion such that said flap is for preventing water from entering said lower portion when said lower portion is coupled to said upper portion; and said flap of each of said appendage portion having a third fastener being for engaging said second fastener of said lower portion such that said third fastener is for securing said flap to said lower portion when said lower portion is coupled to said upper portion.

2. The garment as set forth in claim 1, wherein said first fastener and said third fastener each comprise a first portion of hook and loop fastener, said second fastener comprising a second portion of hook and loop fastener such that said second portion of hook and loop fastener is for releasably engaging said first portion hook and loop fastener.

3. The garment as set forth in claim 1, wherein said main portion is adapted for fitting over an upper torso of the user such that said appendage portions are adapted for covering arms of the user.

4. The garment as set forth in claim 1, wherein said main portion is adapted for fitting over a lower torso of the user such that said appendage portions are adapted for covering legs of the user.

5. A garment for wearing on a body of a user, the garment comprising:

a main portion adapted for covering a portion of the body of the user;

a pair of appendage portions each being adapted for receiving an appendage of the user, each of said appendage portions being coupled to said main portion, each of said appendage portions having an upper portion and a lower portion such that said lower portion is removably coupled to said upper portion;

said upper portion of each of said appendage portions having a first end coupled to said main portion, said upper portion having a free end opposite said first end, said upper portion of each of said appendage portions having a first fastener coupled to an interior surface adjacent said free end;

said lower portion of each of said appendage portions having a second fastener coupled to an exterior surface of said lower portion adjacent a distal end of said lower portion, said second fastener being for releasably engaging said first fastener of said upper portion;

each of said appendage portions comprising a flap coupled to said upper portion of each of said appendage portions adjacent said free end, said flap being for extending over said lower portion such that said flap is for preventing water from entering said lower portion when said lower portion is coupled to said upper portion;

said flap of each of said appendage portion having a third fastener being for engaging said second fastener of said lower portion such that said third fastener is for securing said flap to said lower portion when said lower portion is coupled to said upper portion; and said first fastener and said third fastener each comprising a first portion of hook and loop fastener, said second fastener comprising a second portion of hook and loop fastener such that said second portion of hook and loop fastener is for releasably engaging said first portion hook and loop fastener.

6. The garment as set forth in claim 5, wherein said main portion is adapted for fitting over an upper torso of the user such that said appendage portions are adapted for covering arms of the user.

7. The garment as set forth in claim 5, wherein said main portion is adapted for fitting over a lower torso of the user such that said appendage portions are adapted for covering legs of the user.

* * * * *